US005931655A

United States Patent [19]

Maher, Jr.

[11] Patent Number: 5,931,655

[45] Date of Patent: Aug. 3, 1999

[54] TEMPERATURE CONTROL SYSTEM WITH THERMOELECTRIC AND RECHARGEABLE ENERGY SOURCES

[75] Inventor: Charles A. Maher, Jr., Mustang, Okla.

[73] Assignee: Tridelta Industries, Inc., Mentor, Ohio

[21] Appl. No.: 09/048,471

[22] Filed: Mar. 26, 1998

[51] Int. Cl.[6] ..... F23N 5/26; F23N 5/10

[52] U.S. Cl. ..... 431/14; 431/46; 431/59; 431/80; 236/1 H

[58] Field of Search ..... 431/46, 80, 14, 431/15, 57, 59; 236/1 H

[56] References Cited

U.S. PATENT DOCUMENTS

| | | | |
|---|---|---|---|
| 4,131,413 | 12/1978 | Ryno | 431/44 |
| 4,565,519 | 1/1986 | Carignan | 431/46 |
| 4,696,639 | 9/1987 | Bohan, Jr. | 431/59 |
| 4,717,333 | 1/1988 | Carignan | 431/44 |
| 4,734,658 | 3/1988 | Bohan, Jr. | 331/117 |
| 4,770,629 | 9/1988 | Bohan, Jr. | 431/59 |
| 4,773,847 | 9/1988 | Shukla et al. | 431/46 |
| 4,778,378 | 10/1988 | Dolnick et al. | 431/79 |
| 4,898,531 | 2/1990 | Goldstein et al. | 431/12 |
| 4,906,178 | 3/1990 | Goldstein et al. | 431/79 |
| 5,296,665 | 3/1994 | Peterson et al. | 219/121.57 |
| 5,345,154 | 9/1994 | King | 318/49 |
| 5,365,905 | 11/1994 | Kanehiro et al. | 123/406 |
| 5,399,825 | 3/1995 | Valenzuela | 219/69.13 |
| 5,427,086 | 6/1995 | Brownell | 126/110 R |
| 5,513,618 | 5/1996 | Rich et al. | 123/598 |
| 5,630,661 | 5/1997 | Fox | 362/187 |

*Primary Examiner*—Carroll B. Dority
*Attorney, Agent, or Firm*—Benesch, Friedlander, Coplan & Aronoff LLP

[57] ABSTRACT

A temperature control system for a gas-fired appliance which uses a thermoelectric device to develop power for recharging a primary energy source, such as a rechargeable battery. The present invention provides a reliable and efficient system for controlling and powering a temperature control system.

47 Claims, 3 Drawing Sheets

TEMPERATURE CONTROL SYSTEM WITH THERMOELECTRIC AND RECHARGEABLE ENERGY SOURCES

FIELD OF INVENTION

The present invention generally relates to a temperature control system, and more particularly relates to a temperature control system which is powered by thermoelectric and rechargeable energy sources.

BACKGROUND OF THE INVENTION

Self-energizing temperature control systems have been widely available for several years. These prior art systems have employed either a mechanical bi-metallic thermostat in series with a thermopile and a gas valve, or a so-called solid-state equivalent of this circuit. In this regard, U.S. Pat. Nos. 4,696,639; 4,770,629 and 4,734,658 to Bohan, Jr. disclose a solid-state version of a self-starting free running multi-vibrator to step up the low voltage of a thermoelectric device (e.g., a thermopile). The energy provided by the thermoelectric device (TED) is the sole energy source. Accordingly, in the event that the pilot flame is extinguished, or the TED fails, all power to the temperature control system is lost. Moreover, Bohan's temperature control system requires a user to manually light a standing pilot in order to initially start the system. The actuator for the manually-actuated gas valve cannot be released by the user until the TED is producing sufficient energy. Once the thermopile is up to rated output, the manually-actuated actuated valve for the standing pilot is latched open magnetically by some of the current from the TED.

An indicator light is provided to signal when the user can release the actuator for the manually-actuated gas valve. The indicator light is activated when there is sufficient power from the TED to operate the control system. Typically, the actuator will be not be released for at least three minutes after the pilot burner has been lit. If the actuator is released too soon, the gas valve will shut off and the pilot flame will go out. When this happens the whole process of pilot start-up must be repeated. The indicator light is therefore a convenience feature for the user. A system that lit off the main burner whenever the TED was operational would serve the same purpose.

Gas valves currently in use today that are operated directly by a TED have two (2) coils. One coil is a low power latching coil that is used as a safety device such that if the TED stops putting out power, the safety coil will release and the gas supply to the burners will be shut off. The second coil controls the normal ON/OFF flow of gas to the main burner. Once the standing pilot is lit it remains lit until manually shut off or until for whatever reason the TED stops providing output power. The TED may stop providing power due to the loss of the standing pilot flame and/or failure of the TED itself. If the TED stops providing power, then the safety coil will drop out and the gas flow to burner and pilot will stop. Safety issues are paramount whenever a gas-fired system is being controlled. A dangerous situation will develop anytime gas flows and there is no combustion taking place. Accordingly, it is imperative that the gas flow to a burner and pilot is stopped anytime the burner or pilot flame goes out.

The present invention addresses these and other drawbacks of prior art temperature control systems, to provide a temperature control system with greater reliability, safety and efficiency.

SUMMARY OF THE INVENTION

According to the present invention there is provided a temperature control system for gas fired appliances using a thermoelectric device (TED) to develop power for recharging a primary energy source (PES), such as a rechargeable battery.

An advantage of the present invention is the provision of a temperature control system having a standing pilot ignition.

Another advantage of the present invention is the provision of a temperature control system having a spark ignition.

Another advantage of the present invention is the provision of a temperature control system having a rechargeable energy source to provide a primary source of power for the control system.

Another advantage of the present invention is the provision of a temperature control system having a thermoelectric energy source for recharging the primary energy source.

Still another advantage of the present invention is the provision of a temperature control system which senses when a thermoelectric energy source is inoperative.

Still another advantage of the present invention is the provision of a temperature control system which conserves energy by not continuously exciting the temperature sensing means.

Yet another advantage of the present invention is the provision of a temperature control system having solid-state switches to turn ON and OFF the gas valves.

Still other advantages of the invention will become apparent to those skilled in the art upon a reading and understanding of the following detailed description, accompanying drawings and appended claims.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

Figure 1:
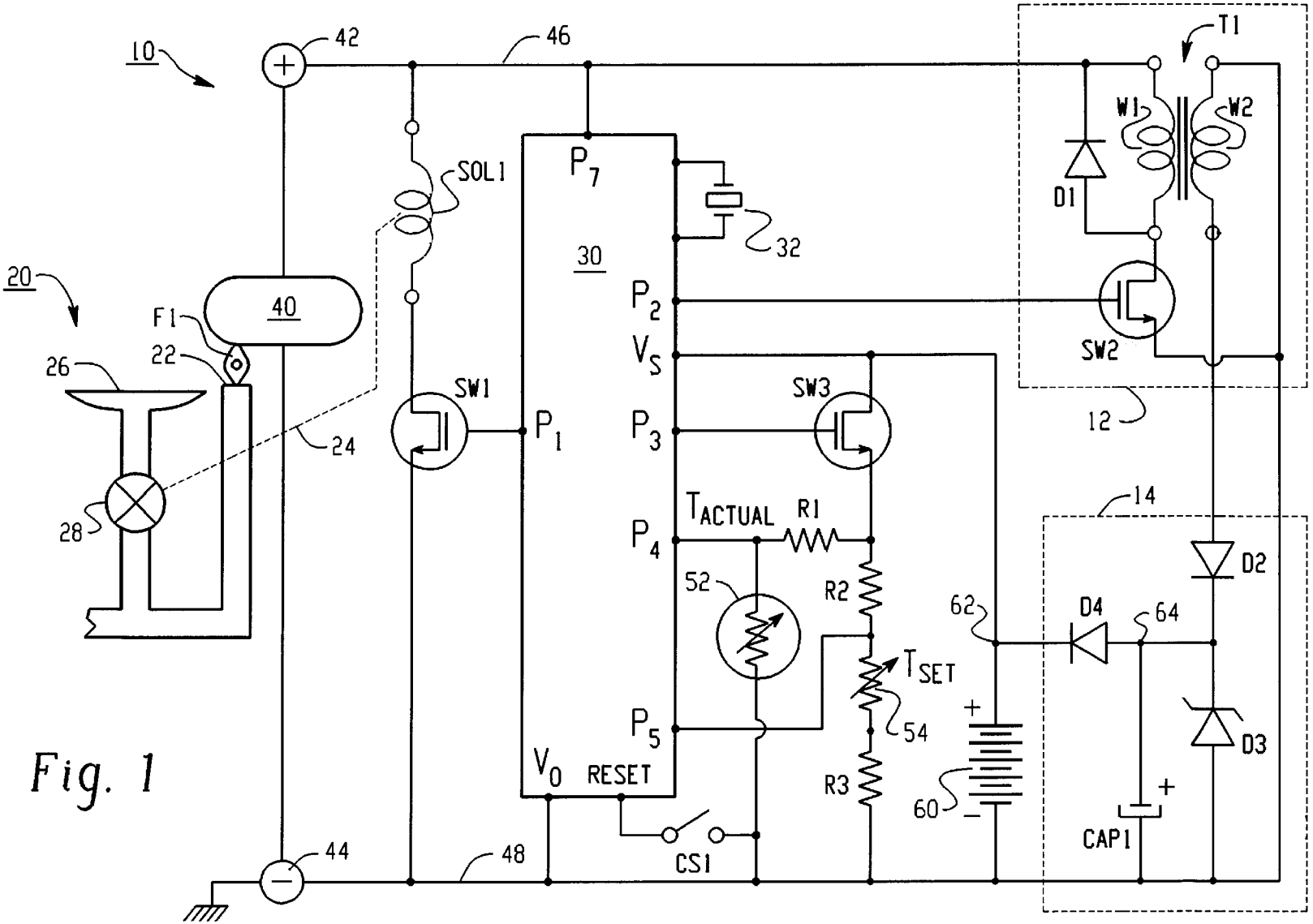
FIG. 1 shows a temperature control system having a standing pilot, according to a first embodiment of the present invention.

The present invention has two primary embodiments. The first embodiment is directed to a temperature control system for a standing pilot system, while the second embodiment is directed to a temperature control system for a spark ignition system.

Referring now to the drawings wherein the showings are for the purposes of illustrating a preferred embodiment of the invention only and not for purposes of limiting same, fuel burner 20 is generally comprised of a pilot burner 22 (standing pilot) and a main burner 26. Pilot burner 22 provides a pilot flame F1 for igniting main burner 26. A main burner gas valve 28 controls the flow of gas to main burner 26 in a conventional manner, well known in the art.

Temperature control system 10 monitors temperature conditions, and controls the operation of gas valve 28 to regulate the amount of heat generated by main burner 26.

Temperature control system 10 is generally comprised of an electromagnetic operating means or solenoid switch SOL1, control means 30, thermoelectric generator means or thermoelectric device (TED) 40, switching means SW1, SW2 and SW3, a transformer T1, a direct current power supply 14, a thermistor 52, a potentiometer 54, and a rechargeable energy source 60.

TED 40 preferably takes the form of a thermopile. A thermopile is comprised of two or more thermocouples connected in series. A thermocouple is a device consisting essentially of an intimate bond between two wires or strips of dissimilar metals (e.g., iron-constanttan (type J)). When the bond is heated, a DC voltage appears across it. TED 40 has a positive output potential 42 and a negative output potential 44. The voltage from terminals 42 and 44 is connected by a pair of conductors 46 and 48 to the balance of temperature control system 10. The output potential of a typical TED is about 750 millivolts unloaded DC (low voltage).

Solenoid SOL1 is linked to gas valve 28 to turn ON (open) and turn OFF (close) gas valve 28. Operation of solenoid SOL1 will be described in further detail below.

Control means 30 provides overall control of temperature control system 10, and preferably takes the form of a suitable CMOS microcontroller or microprocessor, which requires low voltage (i.e., low energy consumption) for operation. According to a preferred embodiment of the present invention, control means 30 includes ports $P_1$, $P_2$, $P_3$, $P_4$, $P_5$, and $P_7$ as well as input pins Vs, Vo and RESET. Output port $P_1$ controls the operation of switching means SW1, output port $P_2$ controls the operation of switching means SW2, and output port $P_3$ controls the operation of switching means SW3. Input port $P_4$ receives a voltage from thermistor 52 indicative of the actual temperature ($T_{ACTUAL}$). Input port $P_5$ receives a voltage from potentiometer 54 indicative of the setpoint temperature ($T_{SET}$). Input port $P_7$ provides an auxiliary input, as will be explained below. An Analog-to-Digital (A/D) converter on control means 30 converts the analog voltages to digital values. It should be appreciated that in an alternative embodiment of the present invention, the A/D converter may be circuitry external to control means 30, or the entire circuit can be of an analog design. Input pin Vs is the supply voltage power input to control means 30, Input pin Vo is connected to ground. The RESET input is connected to a contact switch CS1, which connects to ground when activated to reset control means 30. Operation of control means 30 will be described in further detail below.

Transformer T1 is comprised of two magnetically coupled windings, i.e., primary winding W1 and secondary winding W2.

Thermistor 52 is typically located at a remote location where the temperature is being sensed. When properly excited, thermistor 52 provides a voltage which is indicative of the actual temperature ($T_{ACTUAL}$). This voltage is input to control means 30 via input port $P_4$. It will be appreciated that other temperature sensing devices, such as resistance temperature detectors (RTDs) and thermocouples in conjunction with appropriate signal conditioning circuitry, are suitable substitutes for a thermistor.

Potentiometer 54 is used to select a desired setpoint temperature ($T_{SET}$). In this regard, potentiometer 54 provides a voltage which is indicative of $T_{SET}$. This voltage is input to control means 30 via input port $P_5$. It will be appreciated that other suitable variable resistance means may be substituted for a potentiometer. Moreover, fixed resistance means are suitably used in the case where a fixed setpoint temperature is used.

Thermistor 52, potentiometer 54, and resistors R1, R2 and R3 collectively form a temperature input means for inputting $T_{SET}$ and $T_{ACTUAL}$ to control means 30.

Switching means SW1, SW2 and SW3 preferably take the form of low on-resistance field effect transistors (FETs). However, other solid state switching devices are also suitable. It will be appreciated that use of solid state switching means (rather than an electromechanical contact) provides a high degree of reliability for the temperature control system. In this regard, conventional electro-mechanical contacts are notorious for poor reliability when passing low voltage and low current signals. Moreover, the use of solid state switching means provides improved temperature regulation over that of a mechanical thermostat.

Switching means SW1 controls the operation of main burner gas valve 28 by switching the output of TED 40 through solenoid SOL1 associated with gas valve 28. In this regard, the low voltage provided by TED 40 is used to energize SOL1 to open gas valve 28. Switching means SW1 is controlled through output port $P_1$. Switching means SW2 controls the switching frequency of a converter circuit 12 comprised of switching means SW2, transformer T1 and "freewheeling" diode D1. Converter circuit 12 "steps up" the low voltage generated by TED 40 to a higher voltage. Freewheeling diode D1 protects switching means SW2 from high inductive transients. A complete description of the operation of converter circuit 12 is provided below. Switching means SW3 controls the input of $T_{ACTUAL}$ and $T_{SET}$ to control means 30. In this regard, when SW3 is turned ON current flows through thermistor 52, R1, R2, potentiometer 54 and R3. As a result, thermistor 52 and potentiometer 54 are excited and the voltages indicative of $T_{ACTUAL}$ and $T_{SET}$ are respectively input to control means 30 through input ports $P_4$ and $P_5$. As a result, continuous drain of rechargeable energy source 60 is avoided. It should be appreciated that in an alternative embodiment, thermistor 52 and potentiometer 54 may be suitably arranged in such a manner as to return just the difference signal between them through just one input port (e.g., $P_4$ or $P_5$).

Rechargeable energy source 60 is preferably a rechargeable battery. A super-capacitor is also suitable. The positive terminal 62 of energy source 60 is connected to the supply voltage (Vs) input port of control unit 30, while the negative terminal of energy source 60 is connected to ground.

Solenoid SOL1 for main burner gas valve 28 is connected between the positive terminal 42 and the negative terminal 44 by means of switching means SW1. When switching means SW1 is caused to conduct through a signal received from output port $P_1$, switching means SW1 will cause main burner gas valve 28 to OPEN. As a result, gas valve 28 will admit fuel to main burner 26 where it is ignited by pilot burner flame F1. Accordingly, the switching of switching means SW1 effectively controls the state of main burner 26.

As noted above, converter circuit 12 "steps up" the low voltage generated by TED 40. In this regard, output port $P_2$ outputs a pulsing ON and OFF signal, which in turn switches switching means SW2 ON and OFF at a desired switching frequency. When switching means SW2 is ON, the low voltage generated by TED 40 is placed across winding W1. As a result, the current in winding W1 increases. The current flows in a loop consisting of: winding W1 and TED 40. When switching means SW2 is subsequently turned OFF, current in winding W1 flows in a loop through diode D1 (i.e., a low resistance is placed across winding W1). As a result, the current in winding W1 decays rapidly to zero.

It should be understood that winding W1 of a transformer T1 generally has a lot of inductance associated with it. The net effect of inductance is to store energy and to prevent the current flowing through it from changing. If the current is initially zero and voltage is applied, then the inductance generates a Back EMF to try and prevent the current from increasing. In the process of doing this, energy is stored in the magnetic field of the inductance. If the voltage is suddenly removed, then a voltage is generated so as to keep the current flowing. If the voltage is removed by a mechanical switch for example, then a very large voltage is developed in the open circuit that can result in "arcing." There are several popular techniques for arc suppression. The one employed in a preferred embodiment of the present invention is to provide a low resistance path or loop so that the current can continue to flow and the stored energy rapidly dissipated without generating a potentially damaging high voltage. The diode D1 sometimes has a small current limiting resistor in series with it to protect the diode from an excessive current. A diode used in this fashion is typically referred to as a "Freewheeling" diode.

It should be further understood that the square or pulsed waveform, as is generated herein, is not typically considered to be an AC waveform. The output voltage can approach that of an AC waveform depending on how much filtering effect there is from the inductance of the secondary winding and the load itself. When the output of TED 40 is connected across the primary winding of transformer T1 it is the output voltage of TED 40 that drives the current. The output of TED 40 is a low voltage with a relatively high current. However, a relatively high voltage and as much current as possible is needed to power control means 30 and to recharge rechargeable energy source 60. Transformer T1 is a step-up transformer with a turns ratio that when multiplied by the input voltage will give the desired increase in the output voltage while still having sufficient current to do what needs to be done.

The periodic switching of switching means SW2 supplies a pulsating or oscillating current to primary winding W1, and generally takes the form of a square wave. This oscillating current is "stepped down" while the low input voltage is "stepped-up" and appears as a much higher oscillating output voltage across secondary winding W2, which is the output of converter circuit 12. This increased oscillating output potential is in turn provided to a direct current power supply 14 that includes a rectifier diode D2, a zener diode D3, a storage capacitor CAP1, and a diode D4. The operation of direct current power supply 14 is well known to those skilled in the art. The oscillating output is rectified by diode D2, clipped by zener diode D3, and stored as regulated voltage by filter capacitor CAP1. Accordingly, node 64 becomes a regulated direct current power supply. In a preferred embodiment of the present invention node 64 has a DC regulated voltage of between approximately 3 to 5 volts (high voltage). It should be appreciated that an energy saving benefit may be obtained in using an unregulated voltage, without the loss incurred by using the Zener diode. Moreover, direct current power supply 14 may also include a full wave rectifier, rather than a half-wave rectifier.

When the positive potential (terminal 62) of rechargeable energy source 60 drops below the potential of terminal 64, blocking diode D4 becomes forward biased, thus allowing current to flow. As a result, DC power supply 14 recharges battery 60. It should be appreciated that DC power supply 14 may also provide energy to supply voltage input Vs of control unit 30.

It should be understood that the switching of the primary current of transformer T1 is not free running. As indicated above, the switching frequency is controlled by control means 30. This allows for the most economical and advantageous frequency to be set. In this regard, the chosen frequency should minimize component sizes, optimize the efficiency of the power transformation process (i.e., step-up voltage), and meet the latest and sometimes very stringent EMI standard that are or will be in effect. In accordance with an alternative embodiment of the present invention, control means 30 may run an "adaptive" control program that causes the switching frequency to change as a function of certain operating conditions.

Control means 30 has its control function established by resistors R1, R2 and R3, thermistor 52 and potentiometer 54. In this regard, potentiometer 54 is used to set the reference setpoint temperature ($T_{SET}$) at which temperature control system 10 will operate. Thermistor 52 acts as a temperature sensor to provide an indication of the sensed temperature $T_{ACTUAL}$. Based on the value of the resistance of thermistor 52, the value of the other resistors, and the resistance setting of potentiometer 54, control means 30 will have a controlled output at output port $P_1$. In this regard, control means 30 evaluates the difference between the value of $T_{ACTUAL}$ and $T_{SET}$ to determine whether gas valve 28 should be open or closed. It should be appreciated that since control means 30 may take the form of a programmable microcontroller, control means 30 may be suitably programmed with a setpoint temperature, thus eliminating the need for potentiometer 54.

The output at output port $P_1$ changes in response to the temperature at thermistor 52, and this in turn controls switching means SW1. As noted above, switching means SW1 is connected in a series circuit with solenoid SOL1 associated with main burner gas valve 28. A coupling between solenoid SOL1 is shown at 24. Main burner gas valve 28 and its associated solenoid SOL1 are capable of being operated at the exceedingly low voltage provided by TED 40, when switching means SW1 is ON (i.e., conductive). Alternatively, rechargeable energy source 60 could be used to drive a gas valve requiring a high voltage and lower current.

According to a preferred embodiment of the present invention, the procedure for lighting a standing pilot is to light the pilot manually while manually pressing a button that holds the pilot valve open. A match or some other means is used to light the standing pilot burner. The valve is manually held open until there is sufficient output from TED 40 to hold in the safety coil of the pilot gas valve. However, it should be appreciated that there are other suitable ways of lighting the standing pilot. For instance, a battery or piezoelectric device may provide the energy to activate an igniter, while a pilot light gas valve is held open manually.

The operation of temperature control system 10 will now be described in detail. Once the pilot light has been lit, TED 40 directly provides low voltage to keep the pilot light gas valve open. The flame F1 at pilot burner 22 provides heat to TED 40. In turn, TED 40 provides a low potential direct current at terminals 42 and 44. This potential is supplied to the series connection of solenoid SOL1 and switching means SW1. Upon switching means SW1 being driven into conduction, solenoid SOL1 is energized, causing main burner gas valve 28 to open. The opening of gas valve 28 introduces fuel to main burner 26 and allows fuel burner 20 to provide heat to a load, such as a boiler, a hot water heater, an oven, or a deep fat fryer.

The direct current potential on conductors 46 and 48 is supplied to converter circuit 12. As control means 30 turns switching means SW3 ON and OFF via output port $P_3$, a pulsating or oscillating current potential is input to primary winding W1. This oscillating current is stepped down, while the low input voltage is "stepped-up" and appears as a much higher oscillating output voltage across secondary winding W2. The output potential is in turn provided to power supply 14. Power supply 14 rectifies the voltage to provide a regulated direct current (DC) potential at node 64. In a preferred embodiment, the regulated DC potential is approximately 5 volts. As indicated above, the regulated DC potential is used to recharge the rechargeable energy source 60, during appropriate conditions, as will be explained below. Moreover, the regulated DC potential may also provide the supply voltage Vs to control unit 30.

It should be appreciated that control means 30 can be programmed to detect whether TED 40 is failing or whether pilot flame F1 has been lost, by continuously monitoring the voltage output level of TED 40, for example, via auxiliary input port $P_7$. In this case, control means 30 relies on the power from rechargeable energy source 60, and thus control means 30 is sufficiently powered to take whatever action is required to prevent any dangerous buildup of gas, regardless of the operation state of TED 40.

The rechargeable energy source 60 provides the primary source of power for control means 30. TED 40 in conjunction with converter circuit 12 is used to recharge energy source 60. In a preferred embodiment, rechargeable energy source 60 provides control means 30 with the power that it needs to operate at all times. When gas valve 28 is OFF (i.e., closed), solenoid SOL1 is not energized by the voltage provided by TED 40. Accordingly, the excess energy from TED 40 is available to recharge energy source 60. Rechargeable energy source 60 may also be recharged when main burner gas valve 28 is ON, if TED 40 can generate sufficient energy to simultaneously power rechargeable energy source 60 and main burner gas valve 28.

Since control means 30 is preferably a programmable device, it can be easily modified to include a high degree of intelligence. In this respect, control means 30 may be programmed to sense when TED 40 is not operational, under condition that it should be operating. In the event that TED 40 becomes inoperative, control means 30 can take one or more pre-programmed actions. One such action may be to initiate an audible and/or visual alarm to the user. Another action may be to shut down control means 30 (i.e., initiate a "sleep" mode) to preserve rechargeable energy source 60.

As noted above, control means 30 causes main burner gas valve 28 to open and close based upon the difference between the value of $T_{ACTUAL}$ and $T_{SET}$. Accordingly, control means 30 knows when TED 40 is energizing solenoid SOL1, and thus control means 30 knows when all of the energy from TED 40 is available for recharging. Therefore, control means 30 may be programmed to monitor the state of TED 40 and thereby determine when TED 40 is or is not available to provide excess energy to recharge energy source 60.

It should be appreciated that in an alternative embodiment of the present invention, the output of converter circuit 12 may be fed back in order to better monitor the status of the TED. If the pilot energy source is lost, then it is essential for safety to prevent the main burner from operating (i.e., the main burner gas valve should be closed). In most cases there is a safety coil on the main gas valve that is basically an interlock to prevent the gas from flowing in to the main burner unless there is substantial output from the TED. However, there is no simple way to detect when this event has occurred. Detecting the status of the TED provides this information, albeit there may be a time delay from when the pilot flame goes out until the energy stored in the TED is dissipated.

In order to conserve the energy used for exciting the temperature input means (i.e., thermistor 52 and potentiometer 54), control means 30 does not continuously excite the temperature input means. In this regard, thermistor 52 and potentiometer 54 are only energized by switching means SW3 when it is time to take a measurement of $T_{ACTUAL}$, thereby conserving the total energy use of temperature control system 10. Excitation of the temperature input means occurs only when readings are taken, and the excitation continues only as long as necessary for the readings to stabilize and be acquired by control means 30.

An energy "budget" can be derived for the components of temperature control system 10, during their various modes of operation. One example of an energy budget is illustrated below:

$$E_{BATTERY}+(\text{eff}^*E_{TED})\geqq E_{GV}+E_{MPU}+E_{XTR} \qquad \text{(Equation 1)}$$

where:

$E_{BATTERY}$=Battery stored energy $E_{GV}$=Gas valve driving energy $E_{MPU}$=Microprocessor or microcontroller drain energy $E_{XTR}$=External circuit drain energy $\text{eff}^*E_{TED}$=Net energy from the TED Over the entire operating time, the left side of Equation 1 must be equal to or greater than the right side. Transiently, the right side can exceed the left as long as given sufficient time the deficit is made up.

A typical conservative duty cycle can be assumed from the terms in Equation 1 as TED 40 is sized based on this net energy usage and the surplus needed to make sure that rechargeable energy source 60 is recharged.

Since converter circuit 12 is controlled by control means 30 and is not freewheeling or self-starting, control means 30 can, if it is advantageous to do so, inhibit the step-up action during those periods when solenoid SOL1 is energized. It should be understood that in some cases, it may be advantageous energize solenoid SOL1 directly from rechargeable energy source 60. During those periods when main burner gas valve 28 is OFF, the fully energy output of TED 40 is available to both supply the power to the various energy drains, and to recharge rechargeable energy source 60.

A suitable size for rechargeable energy source 60 is determined primarily by evaluating, under normal operating conditions, what the longest interval of time that the main burner gas valve will be continually open and the energy drain during that interval. It is assumed that this represents the worst case as far as the discharge of energy source 60 is concerned. The alternative is to size TED 60 so that there is always a net charge available after subtracting all the drain values shown on the right side of Equation 1. The life expectancy of rechargeable energy source 60 should preferably be two (2) years or more, under normal operating conditions.

The present invention may also include means for a user to signal control means 30 that its operation should be started or ended. For instance, a switching means may be used to place control means 30 into a "sleep mode" (as discussed above) or to actually open the circuit at the output of the rechargeable energy source. If a user manually turns off the gas, the flame will soon go out. While this is a fail safe condition from a safety standpoint, it could present problems in the event that an ignition feature is included. One way to address this situation is to lock the system out after some programmable number of ignition tries. In the case of a standing pilot, if the flame goes out, TED 40 will "die." Control means 30 will sense this and realize that something is wrong. In turn, control means 30 will shut down and if need be go into a "sleep mode."

Figure 2:
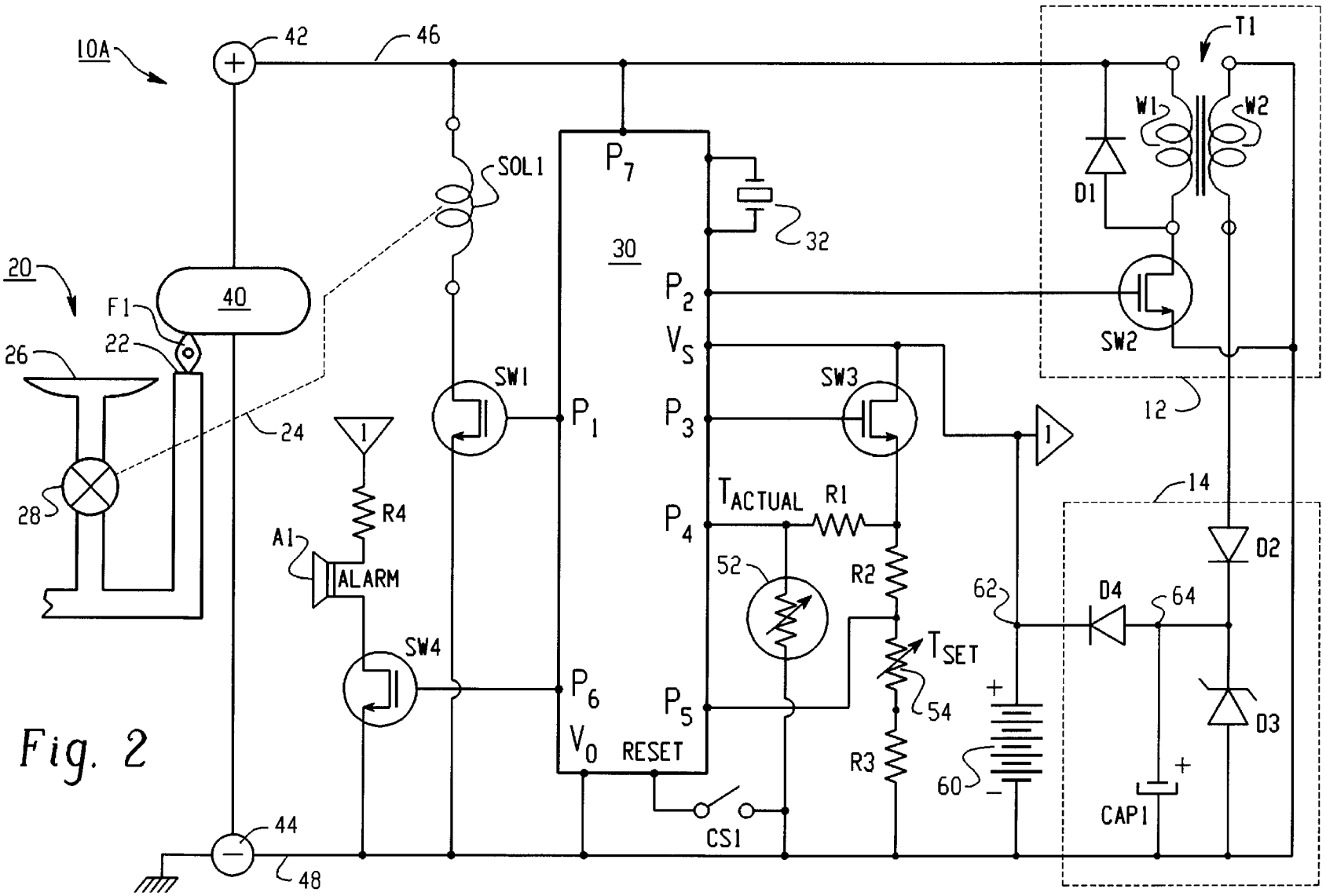
FIG. 2 shows a temperature control system having a standing pilot, according to another embodiment of the present invention.

Referring now to FIG. 2, a modified temperature control system is shown. Temperature control system 10A is essentially the same as temperature control system 10. However, temperature control system 10A includes an alarm A1, which is connected to control means 30 via switch means SW4. Alarm A1 is connected to terminal 62 through resistor R4. Accordingly, rechargeable energy source 60 powers alarm A1. Switch means SW4 is controlled by control means 30 via output port $P_6$. When control means 30 senses that an alarm condition exists (e.g., pilot flame F1 has gone out, TED 40 has stopped producing energy, or an open or shorted temperature sensing probe), switch means SW4 is activated. This, in turn, causes a voltage to be applied to alarm A1. Closing contact switch CS1 (reset) could be used to deactivate alarm A1. In other respects, temperature control means 10A is similar to temperature control means 10, described above.

The future of standing pilot type systems is increasingly threatened by a trend towards more regulations banning their use due to their environmental impact and their waste of energy. The concept embodied in the present invention is equally applicable to a spark ignition system, with solid-state control means to operate the main burner.

Figure 3:
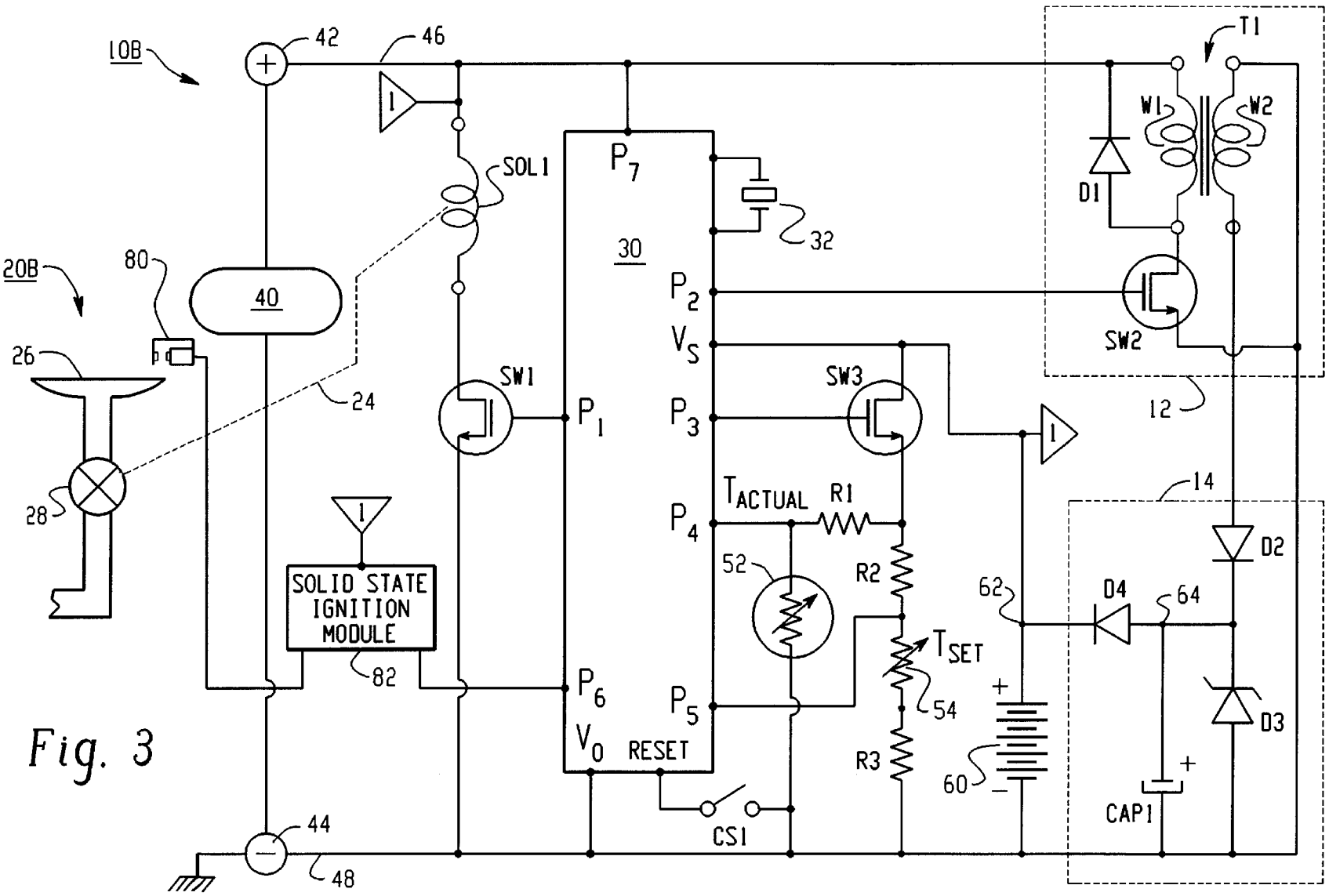
FIG. 3 shows a temperature control system having spark ignition, according to still another embodiment of the present invention.

FIG. 3 shows a temperature control system 10B for use in conjunction with a fuel burner 20B having a spark ignition. A spark generator 80 is provided to directly ignite main burner 26. A solid state ignition module 82 activates spark generator 80 to generate a spark. Solid state ignition module 82 is connected to output port $P_6$ of control means 30, and receives power from terminal 62. Accordingly, rechargeable energy source 60 supplies power to ignition module 82.

Control means 30 activates spark igniter 80 by sending an activation signal to ignition module 82 through output port $P_6$. If main burner gas valve 28 has been activated by control means 30 and is open, the spark at spark igniter 80 will ignite main burner 26.

On start-up, rechargeable energy source 60 provides the power to initially open main burner gas valve 28 and the power to ignition module 82 for generating a spark for igniting main burner 26. TED 40 derives its energy from the heat of the main burner flame. Therefore, once main burner 26 is on, TED 40 begins providing low voltage to solenoid SOL1 to hold main burner gas valve 28 open. In addition, whenever main burner 26 is ON, TED 40 provides energy for recharging the rechargeable energy source 60, using the "stepped-up" DC high voltage from DC power supply 14. When main burner 26 is off, TED 40 cannot provide energy for recharging energy source 60, since it needs the heat from the main burner flame to generate a voltage. In other respects, temperature control system 10B is similar to temperature control system 10, described above.

It should be appreciated that control unit 30 may be programmed with some of the functions that are normally performed by ignition module 82.

In the spark ignition embodiment of the present invention, TED 40 is placed in the main burner flame and is sized large enough to recharge rechargeable energy source 60 each ON/OFF cycle to make up for the total energy expended cycle-to-cycle. Equation 1 is modified below to show the energy drain of an igniter that is fired every time that it is necessary to turn the burner on.

$$E_{BATTERY}+(\text{eff}^*E_{TED})\geqq E_{GV}+E_{MPU}+E_{xtr}+E_{IG} \qquad \text{(Equation 2)}$$

where:

$E_{BATTERY}$=Battery stored energy $E_{GV}$=Gas valve driving energy $E_{MPU}$=Microprocessor or microcontroller drain energy $E_{XTR}$=External circuit drain energy eff*$E_{TED}$=Net energy from the TED $E_{IG}$=Energy drain of the igniter It should be understood that it may be advantageous to input a separate fast acting flame sensor signal into control means 30 to quickly detect a flame out condition. The most important purpose of any safety circuit in a gas-fired system is to prevent the dangerous buildup of gas. An analysis can be conducted to show how quickly TED 40 will decay and when the control means will sense the fact that it is falling and shut the gas off. If a separate flame sensor is deemed necessary, it may be possible to use a device that does not use any significant energy to operate and might actually generate some energy.

The invention has been described with reference to a preferred embodiment. Obviously, modifications and alterations will occur to others upon a reading and understanding of this specification. In particular it is noted that the present invention has been described with reference to a specific control means, converter means and power supply. It is apparent that a number of variations within the concept disclosed could be accomplished within the scope of the present invention. For instance, an oscillation circuit as disclosed in U.S. Pat. No. 4,696,639 could be implemented as the converter means. Moreover, while the present invention has been shown in connection with pilot and spark ignition systems, the present invention is also applicable to other types of ignition systems. For example, the present invention is contemplated for use in conjunction with "intermittent" spark ignitions (wherein a spark is generated to light a gas pilot light, and the gas pilot light is used to light the main burner) and a hot surface ignition (wherein a current is used to heat a conductor, which in turn ignites the gas). It is intended that all such modifications and alterations be included insofar as they come within the scope of the appended claims or the equivalents thereof.

Having thus described the invention, it is now claimed:

1. A temperature control system for burner means including a pilot burner and a main burner having an associated gas valve means for controlling gas thereto, said system comprising:

thermoelectric generator means responsive to a flame from said pilot burner to generate a direct current potential;

switch means for controlling the opening and closing of said gas valve means;

converter means for converting the direct current potential to an oscillating current output voltage;

direct current power supply means for receiving the oscillating output voltage and outputting a direct current (DC) output voltage, wherein said DC output voltage is at a higher potential than said direct current potential;

control means for controlling operation of said switch means in response to an actual sensed temperature and a setpoint temperature, and for activating said converter means; and rechargeable energy source means for supplying power to said control means, said DC output voltage recharging said rechargeable energy source means.

2. A temperature control system according to claim 1, wherein said switch means and said gas valve means are connected in series to said direct current potential.

3. A temperature control system according to claim 1, wherein said system includes:

temperature sensing means for providing said actual sensed temperature to said control means; and temperature setting means for providing said setpoint temperature to said control means.

4. A temperature control system according to claim 3, wherein said temperature sensing means includes a thermistor.

5. A temperature control system according to claim 3, wherein said temperature setting means includes variable resistance means.

6. A temperature control system according to claim 1, wherein said direct current output voltage recharges said rechargeable energy source when the voltage of said rechargeable energy source drops below the direct current output voltage.

7. A temperature control system according to claim 6, wherein said direct current power supply means includes a capacitor for filtering said direct current output voltage.

8. A temperature control system according to claim 1, wherein said thermoelectric generator means includes a thermopile.

9. A temperature control system according to claim 1, wherein said converter means includes a voltage step-up means.

10. A temperature control system according to claim 9, wherein said voltage step-up means includes a transformer.

11. A temperature control system according to claim 1, wherein said switch means is a field effect transistor (FET).

12. A temperature control system according to claim 1, wherein said DC power supply means includes rectifier and capacitor means.

13. A temperature control system according to claim 12, wherein said rectifier and capacitor means includes a zener diode to stabilize the oscillating current output voltage.

14. A temperature control system according to claim 1, wherein said control means includes a CMOS microcontroller.

15. A temperature control system according to claim 14, wherein said CMOS microcontroller has an output port connected to control said switch means which is in series with said fuel valve means.

16. A temperature control system according to claim 1, wherein said system further comprises an alarm means responsive to an output signal from said control means.

17. A temperature control system according to claim 16, wherein said control system activates said alarm means when said rechargeable energy source has dropped below a predetermined potential.

18. A temperature control system for burner means including an ignition means having an igniter and an associated solid state ignition module, and a main burner having an associated gas valve means for controlling gas thereto, said system comprising:

thermoelectric generator means responsive to a flame from said main burner to generate a direct current potential;

switch means for controlling the opening and closing of said gas valve means;

converter means for converting the direct current potential to an oscillating current output voltage;

direct current power supply means for receiving the oscillating output voltage and outputting a direct current (DC) output voltage, wherein said DC output voltage is at a higher potential than said direct current potential;

control means for controlling operation of said switch means in response to an actual sensed temperature and a setpoint temperature, and for activating said converter means; and rechargeable energy source means for supplying power to said control means, said DC output voltage recharging said rechargeable energy source means.

19. A temperature control system according to claim 18, wherein said switch means and said gas valve means are connected in series to said direct current potential.

20. A temperature control system according to claim 18, wherein said system includes:

temperature sensing means for providing said actual sensed temperature to said control means; and temperature setting means for providing said setpoint temperature to said control means.

21. A temperature control system according to claim 20, wherein said temperature sensing means includes a thermistor.

22. A temperature control system according to claim 20, wherein said temperature setting means includes variable resistance means.

23. A temperature control system according to claim 18, wherein said direct current output voltage recharges said rechargeable energy source when the voltage of said rechargeable energy source drops below the direct current output voltage.

24. A temperature control system according to claim 23, wherein said direct current power supply means includes a capacitor for filtering said direct current output voltage.

25. A temperature control system according to claim 18, wherein said thermoelectric generator means includes a thermopile.

26. A temperature control system according to claim 18, wherein said converter means includes a voltage step-up means.

27. A temperature control system according to claim 26, wherein said voltage step-up means includes a transformer.

28. A temperature control system according to claim 18, wherein said switch means is a field effect transistor.

29. A temperature control system according to claim 18, wherein said DC power supply means includes rectifier and capacitor means.

30. A temperature control system according to claim 29, wherein said rectifier and capacitor means includes a zener diode to stabilize said oscillating output voltage.

31. A temperature control system according to claim 18, wherein said control means includes a CMOS microcontroller.

32. A temperature control system according to claim 31, wherein said CMOS microcontroller has an output port connected to control said switch means which is in series with said fuel valve means.

33. A temperature control system for a burner means including main burner means having an associated gas valve means for controlling a supply of gas thereto, and ignition means for igniting the main burner, said system comprising:

thermoelectric generator means responsive to a flame from one of said main burner means and said ignition means to generate a direct current potential;

voltage conversion means for converting the direct current potential to a direct current (DC) output voltage, wherein said DC output voltage is at higher potential than said direct current potential;

control means for controlling operation of the associated gas valve means, the ignition means, and the voltage conversion means, and for monitoring an actual sensed temperature and a setpoint temperature; and rechargeable energy source means for supplying power to said control means, said DC output voltage recharging said rechargeable energy source means.

34. A temperature control system according to claim 33, wherein said system includes switch means for controlling the opening and closing of said gas valve means.

35. A temperature control system according to claim 33, wherein said voltage conversion means includes:

converter means for converting the direct current potential to an oscillating current output voltage; and direct current power supply means for receiving the oscillating output voltage and outputting said direct current (DC) output voltage.

36. A temperature control system according to claim 33, wherein said system includes:

temperature sensing means for providing said actual sensed temperature to said control means; and temperature setting means for providing said setpoint temperature to said control means.

37. A temperature control system according to claim 33, wherein said temperature sensing means includes a thermistor.

38. A temperature control system according to claim 33, wherein said temperature setting means includes variable resistance means.

39. A temperature control system according to claim 33, wherein said direct current output voltage is used to recharge said rechargeable energy source when the voltage of said rechargeable energy source drops below the direct current output voltage.

40. A temperature control system according to claim 35, wherein said direct current power supply means includes a capacitive circuit means for filtering said direct current output voltage.

41. A temperature control system according to claim 33, wherein said thermoelectric generator means includes a thermopile.

42. A temperature control system according to claim 33, wherein said system further comprises an alarm means responsive to an output signal from said control means.

43. A temperature control system according to claim 42, wherein said control system activates said alarm means when said rechargeable energy source has dropped below a predetermined potential.

44. A temperature control system according to claim 33, wherein said ignition means includes a standing pilot burner, said thermoelectric generator means responsive to a flame from the standing pilot burner.

45. A temperature control system according to claim 33, wherein said ignition means includes a solid state spark ignition means, said thermoelectric generator means responsive to a flame from said main burner means.

46. A temperature control system according to claim 33, wherein said ignition means includes a hot surface ignition having a hot surface igniter for igniting said main burner, said thermoelectric generator means responsive to a flame from said main burner.

47. A temperature control system according to claim 33, wherein said ignition means includes an intermittent solid state spark ignition for igniting a pilot burner, said thermoelectric generator means responsive to a flame from said main burner means.

* * * * *